US011214090B1

(12) United States Patent
Luis

(10) Patent No.: US 11,214,090 B1
(45) Date of Patent: Jan. 4, 2022

(54) BINDING DEVICE AND METHOD OF USING

(71) Applicant: Spiral Binding LLC, Totowa, NJ (US)

(72) Inventor: Humberto Luis, Fatima (PT)

(73) Assignee: Spiral Binding LLC, Totowa, NJ (US)

( * ) Notice: Subject to any disclaimer, the term of this patent is extended or adjusted under 35 U.S.C. 154(b) by 0 days.

(21) Appl. No.: 17/076,168

(22) Filed: Oct. 21, 2020

(51) Int. Cl.
*B42C 9/00* (2006.01)
*B41M 5/00* (2006.01)
*B42D 3/02* (2006.01)

(52) U.S. Cl.
CPC ..... *B42C 9/00* (2013.01); *B41M 5/0064* (2013.01); *B42D 3/02* (2013.01); *B42P 2241/28* (2013.01)

(58) Field of Classification Search
CPC ..... B42C 9/00; B42D 3/02; B41M 5/0064; B41M 5/00; B42P 2241/28
USPC ..... 40/726; 281/3.1, 15.1, 20; 402/4, 60, 402/62, 70, 500
See application file for complete search history.

(56) References Cited

U.S. PATENT DOCUMENTS 3,099,268 A * 7/1963 Smith ..... B42F 7/06 40/537
6,196,748 B1 * 3/2001 Schwartz ..... B42F 13/12 281/29

* cited by examiner

*Primary Examiner* — Justin V Lewis
(74) *Attorney, Agent, or Firm* — Wendi E. Uzar

(57) ABSTRACT

A binding device and method that allows pages or documents to be secured in a binder while providing a recyclable, transparent and printable cover. The binding device includes a flexible sheet having a front surface, a rear surface, a first, second, third and fourth edge, a fold parallel to the first edge on the flexible sheet that extends from the second edge to the fourth edge, a plurality of spaced apart die cuts adjacent the fold shaped to form tabs, a transparent flexible front cover having a front surface, rear surface, a first, second, third and fourth edge, the first edge of the front cover overlapping and affixing to the front surface of the flexible sheet.

18 Claims, 6 Drawing Sheets

BINDING DEVICE AND METHOD OF USING

FIELD OF THE INVENTION

The invention relates to a device for binding pages such as documents, presentations or the like. In particular, an improved device that can be easily manipulated to securely bind and wrap around documents and provide an environmentally friendly, transparent and printable cover. The device allows the documents to be aligned and affixed quickly while allowing the cover to be printed thereon.

BACKGROUND OF THE INVENTION

A wide variety of binders exist. The essential elements of most known binders include a cover and a binding coil or rings to retain the documents within the cover. Binders are generally difficult to manipulate and the binding coil or rings can vary in quality of materials and installation. When binding documents the user has to carefully and precisely insert the documents within the cover and use the binding coil or rings to secure the documents in place. The user will generally have to cut or punch their documents to be affixed within the binding coil or ring.

The cover of a binder is generally opaque and the documents affixed within the binder are not viewable there through. Providing a cover with that is capable of having personalized printing and text is problematic. The cover is commonly produced from a plastic material. The first page of the document is commonly covered and not visible from the outside of the binder. Moreover, the cover is generally not able to be customized or printed thereon.

Providing a cover made from a plastic material is problematic. Last year more than 8 million tons of plastic was dumped into our oceans. Plastic binding covers made from polypropylene can take over 400 years to biodegrade however documents using paper-based covers do not need to be separated into their respective parts to be recycled.

Therefore, there is a need for a binder that can align and secure documents quickly and effectively while providing a paper-based cover that is recyclable, transparent and printable.

SUMMARY OF THE INVENTION

The present invention seeks to solve the challenge of binding documents by providing a cover that eliminates the need for a) a separate binding coil or ring within the binder, b) the documents be punched before they are secured therein, c) a separate cover or sticker to personalize the cover or first page of the document or presentation, d) having to open the cover to see the documents within the binder and d) producing additional waste that cannot be recycled which achieves the purpose set forth above as follows:

The binder for easily aligning documents while providing a recyclable and printable cover comprises a flexible sheet having a first, second, third and fourth edge, a fold parallel to the first edge on the flexible sheet that extends from the second edge to the fourth edge, a plurality of spaced apart die cuts adjacent the fold shaped to form tabs, a transparent flexible front cover having a first, second, third and fourth edge, the first edge of the front cover overlapping and affixing to the first edge of the flexible sheet.

Preferably the flexible sheet is made from paper. The weight of the paper of the flexible sheet is preferably between 150-300 grams per square meter (gsm). Preferably the flexible sheet has a generally rectangular shape but it may have a circular, triangular or other shape. When the flexible sheet has a rectangular shape it has four edges and four corners. The corners may be rounded. The flexible sheet may be offered in various colors.

The flexible sheet may also be made from alternative materials such as cardstock, cardboard wood, plastic, metal, foam or fiberboard.

The die cuts on the flexible sheet may extend generally perpendicularly from the fold, turn approximately 90 degrees and extend parallel to the fold and then back perpendicularly to the fold forming a rounded rectangular tab. Preferably the die cut forms a generally rectangular shape but it may have a circular, triangular or other shape. The die cut may form alternative shapes such as squares, circles, polygons or the like.

The cover may be affixed to the flexible sheet using an adhesive or any other method known to those skilled in the art such as mechanical means, heat or sonic weld. If an adhesive is used, the adhesive is applied to the first edge of the flexible sheet and the first edge of the cover is placed onto the adhesive as it overlaps and covers the first edge of the flexible sheet. The adhesive may consist of any product known to those skilled in the art including, but not limited to, glue, cement, mucilage, paste, gum or binder.

The cover is environmentally friendly. It contains no plastic and is recyclable, compostable and biodegradable. The cover is manufactured with paper pulp that is unbleached chlorine free. It is preferred that the cover be 100% recyclable. It is also contemplated that the cover be made from bioplastics.

Preferably the cover is made from a transparent paper. The weight of the paper of the cover is preferably between 120-250 grams per square meter (gsm). Preferably the cover has a generally rectangular shape but it may have a circular, triangular or other shape. When the cover has a rectangular shape it has four edges and four corners. The corners may be rounded. The cover is preferably offered in a matte frost finish.

The cover is preferably printable. The cover can be printed on to add verbiage or other marking prior to adhering the cover to the flexible sheet like material. It is preferable that the cover be printed in an office or personal printer.

To manufacture the present invention, the cover and flexible sheet are cut to size from large sheets of material. The cover and the flexible sheet are then affixed together using an adhesive. The flexible sheet is then die-cut in order to produce the tabs.

The method of binding documents comprises providing a plurality of documents having an edge, providing a flexible sheet having a first, second, third and fourth edge, a fold parallel to the first edge on the flexible sheet that extends from the second edge to the fourth edge, a plurality of spaced apart die cuts adjacent the fold shaped to form tabs, providing a transparent flexible front cover having a first, second, third and fourth edge, the first edge of the front cover, applying an adhesive to the first edge of the flexible sheet, placing the first edge of the cover overlapping said adhesive on the first edge of the flexible sheet, and pressing the cover firmly down thereby adhering it to said flexible sheet, providing the plurality of documents within the flexible sheet and cover, aligning the edge of the documents to the tabs of the flexible sheet like, stapling the edge of the documents between the tabs and the flexible sheet.

The method of binding documents may further comprise providing a printer to add verbiage or other marking to the cover prior to adhering the cover to the flexible sheet.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
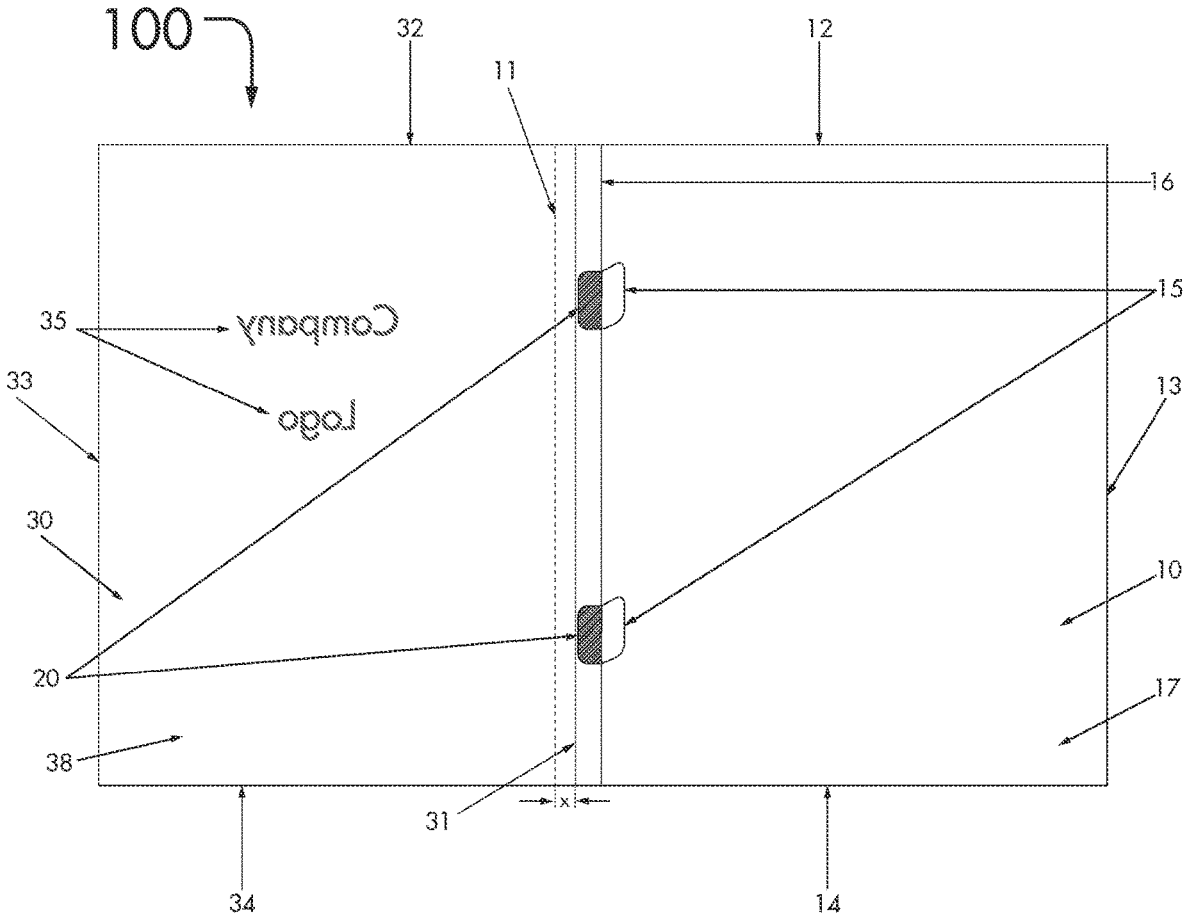
FIG. 1 is a front elevational view of the binder of the present invention in an open position.
Figure 2:
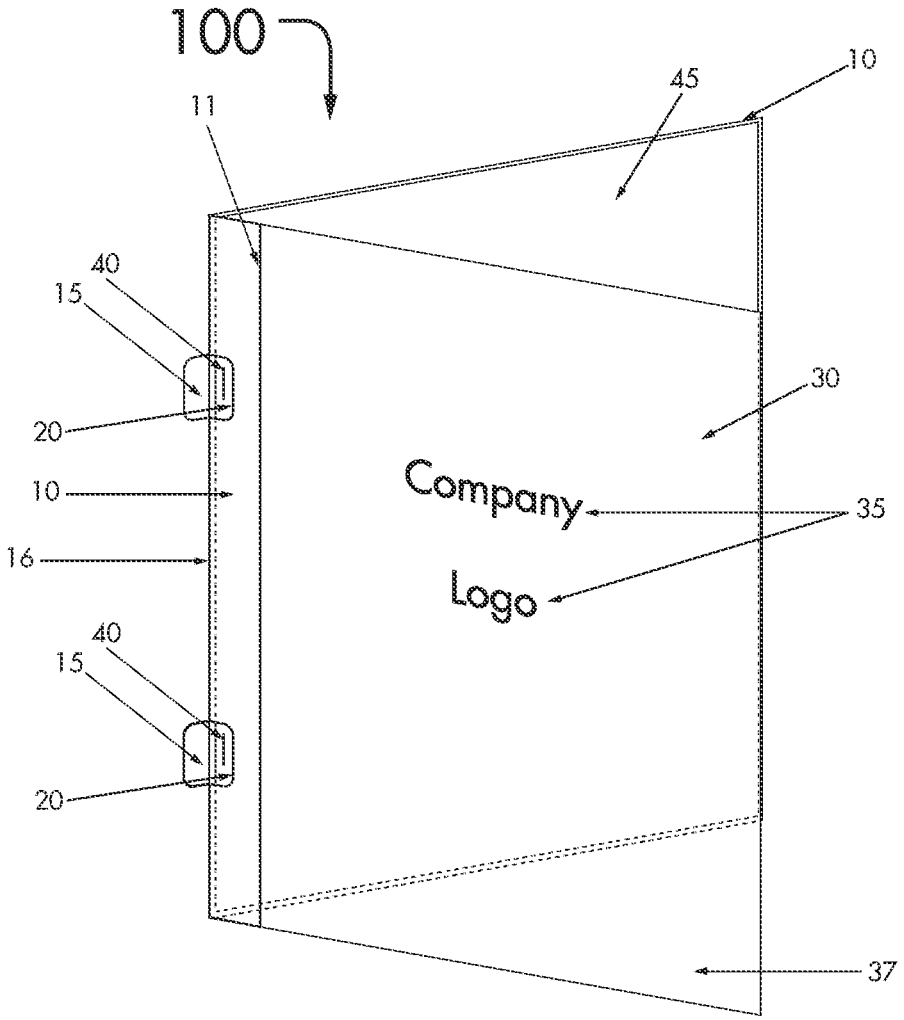
FIG. 2 is a front elevational view of the binder of the present invention in a partially closed position shown with the tabs extending.
Figure 3:
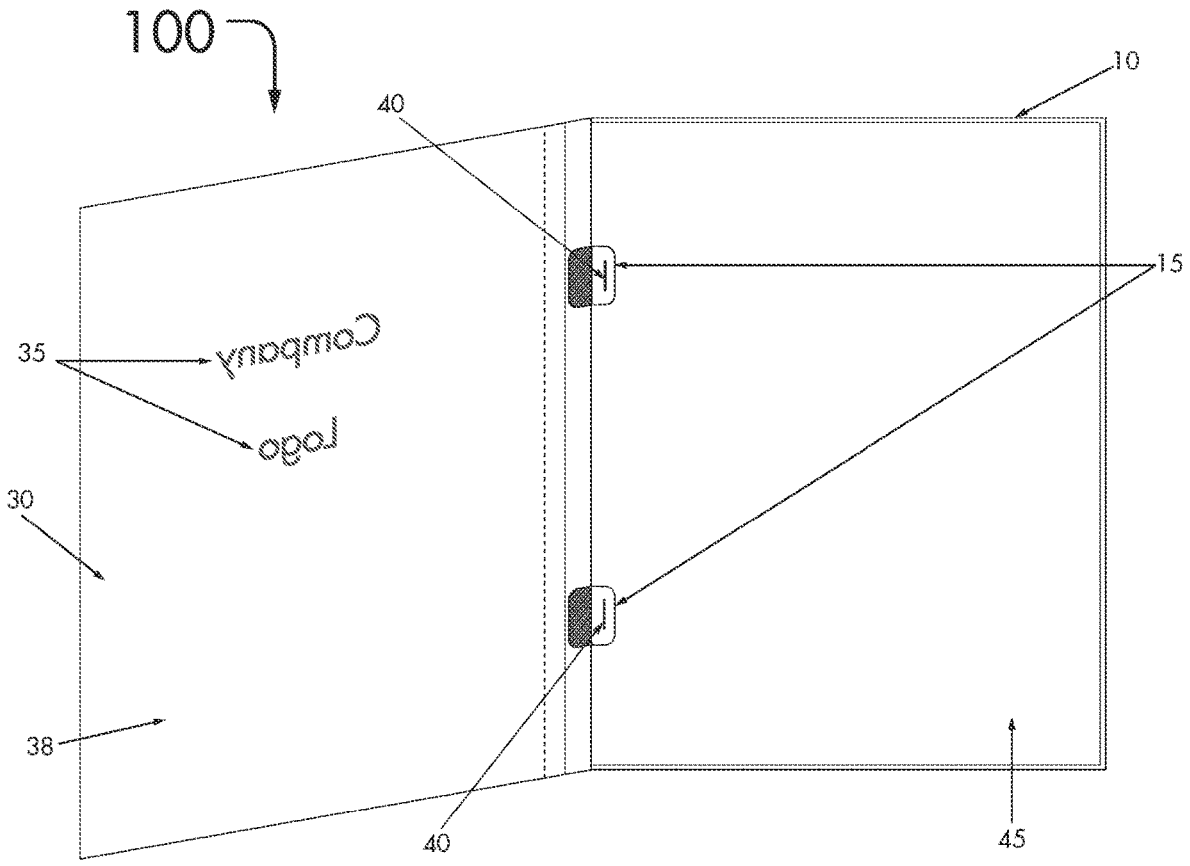
FIG. 3 is a front elevational view of the binder of the present invention in an open position with documents affixed to the tabs.
Figure 4:
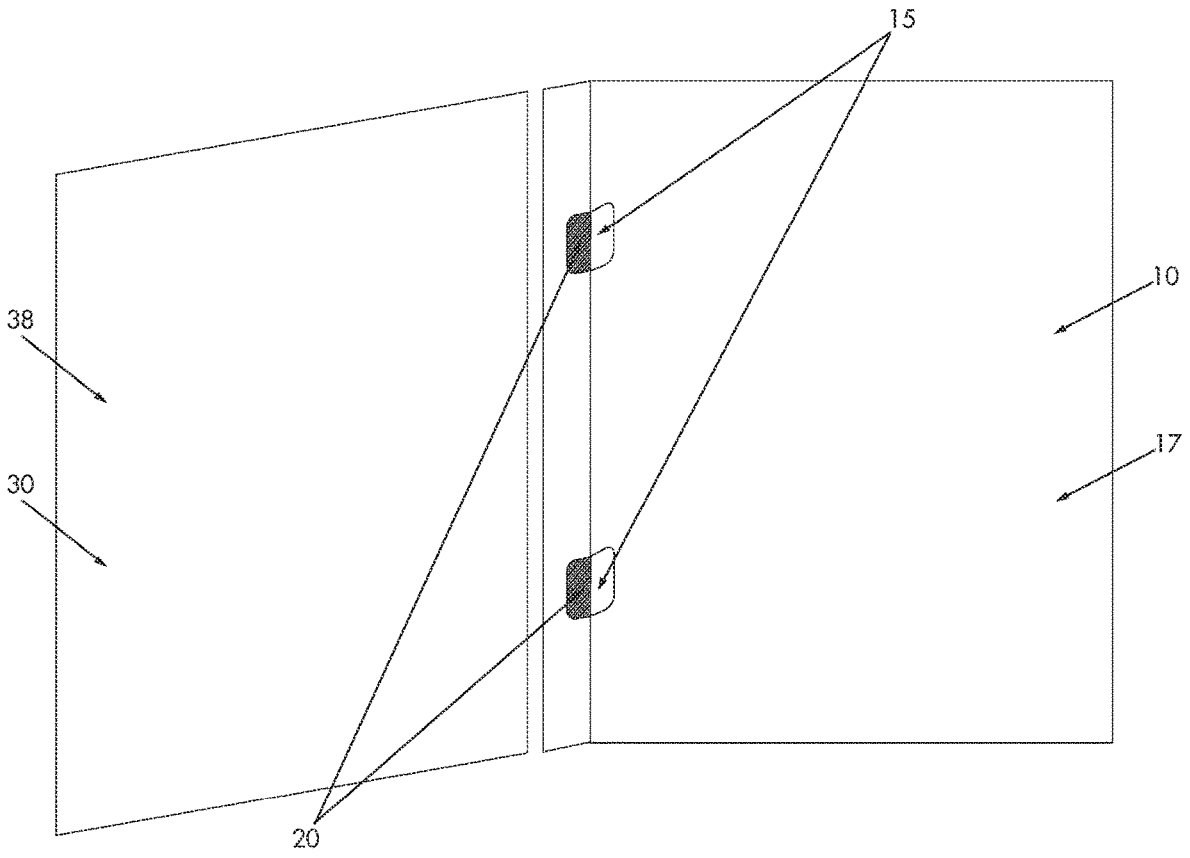
FIG. 4 is front exploded view of the binder of the present invention.

With reference to the drawings, wherein the same reference number indicates the same element throughout, there is shown in FIGS. 1-3 a front elevational view of a binding device 100 of the present invention. As shown in FIG. 1, the binding device 100 includes a flexible sheet 10 having a front surface 17, a rear surface (not shown), a first 11, second 12, third 13 and fourth edge 14. There is a fold 16 on the flexible sheet 10 that is parallel to the first edge 11 of the flexible sheet 10 and extends from the second edge 12 to the fourth edge 14. The flexible sheet 10 has a plurality of spaced apart apertures or die cuts 20 that are adjacent the fold 16 and shaped to form tabs 15.

The binder 100 of the present invention further comprises a front cover 30 having a front surface 37, a rear surface 38, a first 31, second 32, third 33 and fourth edge 34. To affix the front cover 30 to the flexible sheet 10, an adhesive on area X of the front surface 17 of the flexible sheet 10 between the first edge 11 and the fold 16 is adhered to the front surface 37 of the front cover 30. When the front cover 30 is affixed to the flexible sheet 10, the first edge 31 of the front cover 30 overlaps the first edge 11 of the flexible sheet 10 and covers an area X of the flexible sheet 10.

The front cover 30 is environmentally friendly and is preferably made from paper pulp that is unbleached and chlorine free, contains no plastic, is recyclable, compostable and biodegradable. It is preferred that the front cover 30 is 100% recyclable. It is also contemplated that the cover be made form bioplastics.

The front cover 30 is transparent or at least partially transparent and allows for documents 45 or papers placed under it to be seen there through. The weight of the paper of the cover 30 is preferably between 120-250 grams per square meter (gsm). Preferably the front cover 30 has a generally rectangular shape but it may have a circular, triangular or other shape. When the cover has a rectangular shape it has four edges and four corners. The corners may be rounded. The front cover 30 is preferably offered in a matte frost finish. The front cover 30 is preferably flexible but may be rigid.

It is anticipated that the front cover 30 may be printable and can be printed on to add verbiage 35 or other marking prior to adhering the cover 30 to the flexible sheet 10. The printing can be accomplished with an office or a personal home printer. In the preferred embodiment of the present invention, the rear surface 38 of the front cover 30 has verbiage printed thereon.

To manufacture the binding device 100 of present invention, the front cover 30 and flexible sheet 10 are cut to size from large sheets of material. The front cover 30 and the flexible sheet 10 are then affixed together using an adhesive along area X of the flexible sheet 10. The flexible sheet 10 is then die-cut 20 in order to produce the tabs 15.

The method of binding documents using the binding device 100 comprises providing a plurality of documents 45 having an edge, providing a flexible sheet 10 having a front surface 17, a rear surface (not shown), a first 11, second 12, third 13 and fourth edge 14, a fold 16 parallel to the first edge 11 on the flexible sheet 10 that extends from the second edge 12 to the fourth edge 14, a plurality of spaced apart apertures or die cuts 20 adjacent the fold 16 shaped to form tabs 15, providing a front cover 30 having a front surface 37, a rear surface 38, a first 31, second 32, third 33 and fourth edge 34, applying an adhesive (not shown) to area X on the front surface 17 adjacent to the first edge 11 of the flexible sheet 10, placing the first edge 31 of the front cover 30 overlapping said adhesive on area X of the flexible sheet 10, and pressing the front surface 37 of the front cover 30 firmly down thereby adhering it to said flexible sheet 10, providing the plurality of documents 45 within the flexible sheet 10 and cover 30, aligning the edge of the documents to the tabs 15 of the flexible sheet 10, stapling 40 the edge of the documents 45 between the tabs 15 and the flexible sheet 10. For the documents 45 to align properly within the binding device 100 the flexible sheet 10 is longer in the direction of its second edge 12 then the length of the front cover 30 along its second edge 32.

As shown in FIG. 2, when the documents 45 and bound within the binding device 100 the front cover 30 is folded along the fold 16 and covers the flexible sheet 10. The front cover 30 and the flexible sheet 10 are sized and affixed so that when folded along fold 16 the second edge of the flexible sheet 12 and the second edge of the front cover 32 align, the third edge of the flexible sheet 13 aligns with the third edge of the front cover 33 and the fourth edge of the flexible sheet 14 aligns with the fourth edge of the front cover 34. The documents 45 are viewable through the front cover 30. The front cover 30 may have text 35 or other writing thereon.

The method of binding documents may further comprise providing a printer to add verbiage or other marking to the front cover 30 prior to adhering the front cover 30 to the flexible sheet 10.

Figure 5:
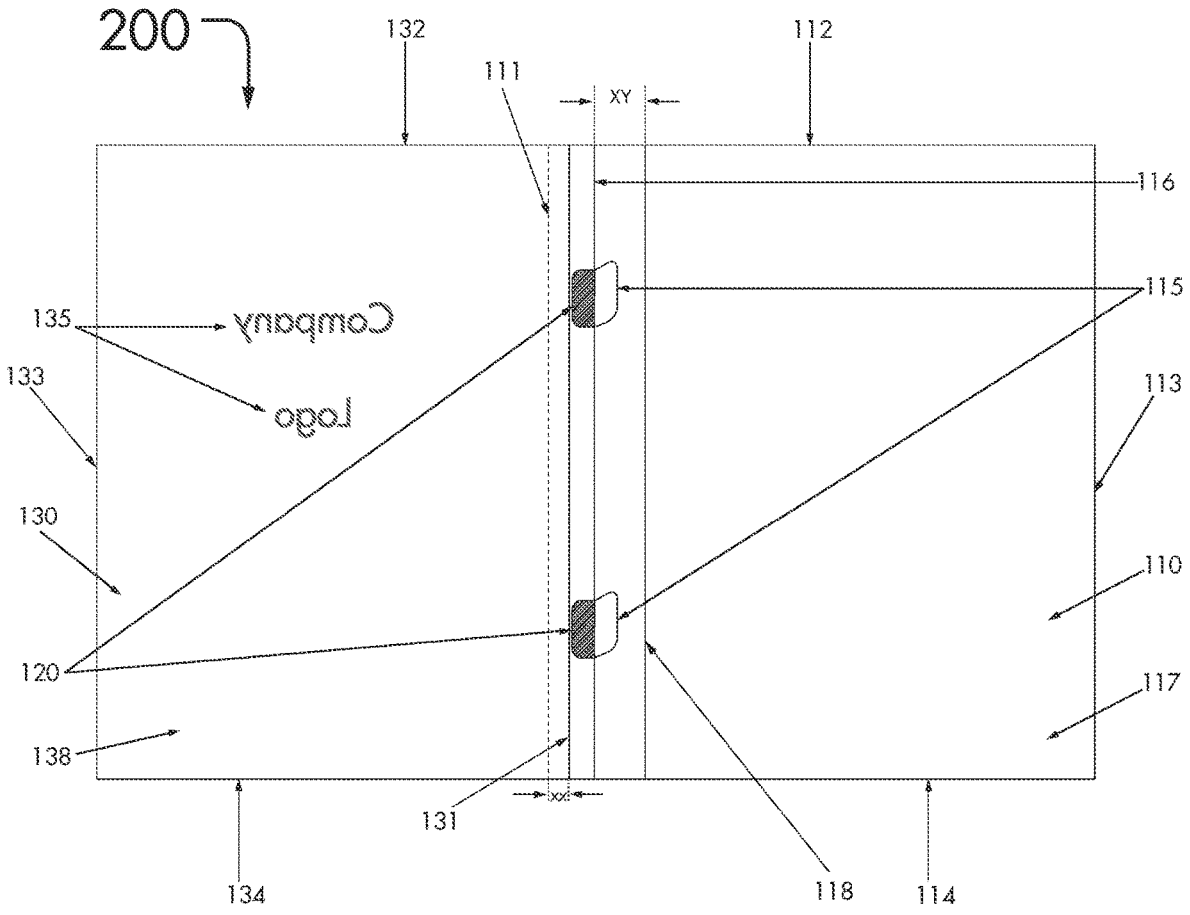
FIG. 5 is a front elevational view of a second embodiment of the present invention in an open position.

Another embodiment of the present invention is shown in FIG. 5, alternative binding device 200 which is structurally similar to the binding device 100 as shown in FIGS. 1-4 and includes a flexible sheet 110 having a front surface 117, a rear surface (not shown), a first 111, second 112, third 113 and fourth edge 114. There is a first fold 116 on the flexible sheet 110 that is parallel to the first edge 111 of the flexible sheet 10 and extends from the second edge 112 to the fourth edge 114. The flexible sheet 110 has a plurality of spaced apart apertures or die cuts 120 that are adjacent the first fold 116 and shaped to form tabs 115. The flexible sheet 100 contains a second fold 118 that extends parallel to the first fold 116, from the second edge 112 of the flexible sheet 110 to the fourth edge 114 and is located between the first fold 116 and the third edge 113. The second fold 118 allows for a larger amount of documents to be bound within the binder 200 by providing a spine area XY on the binding device 200.

Similarly to the first embodiment of the present invention as shown in FIG. 5, the binder 200 of the second embodiment of the present invention further comprises a front cover 130 having a front surface 137, a rear surface 138, a first 131, second 132, third 133 and fourth edge 134. To affix the front cover 130 to the flexible sheet 110, an adhesive on area XX of the front surface 117 of the flexible sheet 110 between the first edge 111 and the first fold 116 is adhered to the front surface 137 of the front cover 130. When the front cover 130 is affixed to the flexible sheet 110, the first edge 131 of the front cover 130 overlaps the first edge 111 of the flexible sheet 110 and covers an area XX of the flexible sheet 110.

Similarly to the first embodiment of the present invention, the front cover 130 of the binding device 200 is environmentally friendly and is made from paper pulp that is unbleached and chlorine free, contains no plastic, is recyclable, compostable and biodegradable. It is preferred that the front cover 130 is 100% recyclable.

Figure 6:
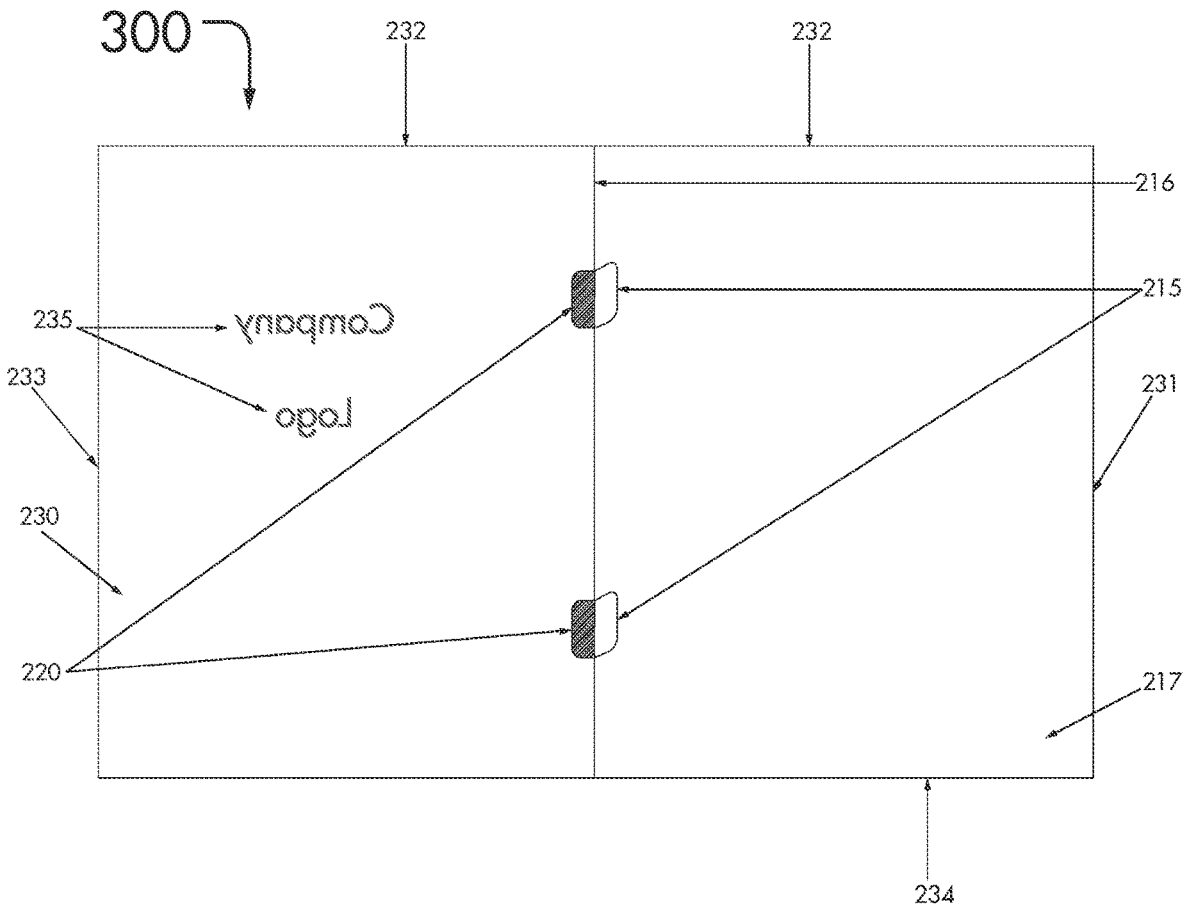
FIG. 6 is a front elevational view of a third embodiment of the present invention in an open position.

FIG. 6 shows a third embodiment of the present invention, the one sheet alternative binding device 300 includes a flexible sheet 230 having a front surface 217, a rear surface (not shown), a first 231, second 232, third 233 and fourth edge 234. There is at least one fold 216 on the flexible sheet 230 that extends parallel to the first edge 231 of the flexible sheet 230 and extends from the second edge 232 to the fourth edge 234. In the preferred embodiment, the fold 216 is located in the middle of the first 231 and third 233 edges. It is contemplated that the flexible sheet includes a second fold parallel to the fold 216 that creates a spine area. The flexible sheet 230 has a plurality of spaced apart apertures or die cuts 220 that are adjacent the fold 216 and shaped to form tabs 215.

The alternative binding device 300 of the present invention is similar to the binding devices 100 and 200 of the present invention however the front cover is a part of the flexible sheet 230 and removes the need for two separate components. In the alternative binding device 300, the flexible sheet 230 is similar to the front cover of the first embodiment and is preferably environmentally friendly and is preferably made from paper pulp that is unbleached and chlorine free, contains no plastic, is recyclable, compostable and biodegradable. It is also contemplated that it be made from bioplastics. It is preferred that the front cover 230 is 100% recyclable. The flexible sheet 230 is transparent or at least partially transparent and allows for documents or papers enclosed therein to be seen there through. The weight of the paper of the flexible sheet 230 is preferably between 120-250 grams per square meter (gsm). Preferably the flexible sheet 230 has a generally rectangular shape but it may have a circular, triangular or other shape. When the flexible sheet 230 has a rectangular shape it has four edges and four corners. The corners may be rounded. The flexible sheet 230 is preferably offered in a matte frost finish.

The flexible sheet 230 of alternative binding device 300 is preferably printable and can be printed on to add verbiage 235. The printing can be accomplished with an office or a personal home printer. In the preferred embodiment of the present invention, the rear surface of the flexible sheet 230 has verbiage 235 printed thereon that is viewable from the front surface 217 of the flexible sheet 230.

The features of the invention illustrated and described herein are the preferred embodiments. Therefore, it is understood that the appended claims are intended to cover unforeseeable embodiments with insubstantial differences that are within the spirit of the claims.

What I claim is:

1. A binding device for easily compiling documents comprising:
- a flexible sheet having a front surface, a rear surface, a first, second, third and fourth edge;
- a fold that extends parallel to said first edge of said flexible sheet, said fold extends from said second edge to said fourth edge of said flexible sheet;
- a plurality of spaced apart apertures in said flexible sheet, adjacent to said fold, shaped to form tabs;
- an adhesive on said front surface of said flexible sheet between said first edge and said fold;
- a front cover having a front surface, a rear surface, a first, second, third and fourth edge;
- an area of said front surface of said front cover adjacent said first edge of said front cover overlapping and adhering to said adhesive on said front surface of said flexible sheet; and
- said front cover being flexible.

2. The binding device of claim 1 wherein said front cover is made from paper.

3. The binding device of claim 1 wherein said front cover is at least partially transparent.

4. The binding device of claim 1 wherein said front cover and said flexible sheet have a rectangular shape.

5. The binding device of claim 1 wherein said front cover is recyclable.

6. The binding device of claim 1 wherein said front cover is biodegradable.

7. The binding device of claim 1 wherein said front cover is capable of being printed on by a printer.

8. The binding device of claim 1 wherein said adhesive is selected from the group consisting of: glue, cement, mucilage, paste, gum and binder.

9. The frame of claim 1 wherein said front cover is made from paper having a weight between 120-250 grams per square meter.

10. The binding device of claim 1, said flexible sheet further comprising a second fold that extends parallel to said fold, from said second edge to said fourth edge of said flexible sheet between said fold and said third edge of said flexible sheet creating a spine area.

11. The binding device of claim 1 wherein said tabs have a rectangular shape.

12. The binding device of claim 1 wherein said flexible sheet has two spaced apart apertures.

13. The binding device of claim 11 wherein said apertures have the same shape as said tabs.

14. The binding device of claim 1 wherein said front cover is flexible.

15. A binding device for compiling documents comprising:
- a flexible sheet having a front surface, a rear surface, a first, second, third and fourth edge;
- at least one fold that extends parallel to said first edge of said flexible sheet, said fold extending from said second edge to said fourth edge of said flexible sheet;
- a plurality of spaced apart apertures in said flexible sheet, adjacent to said fold, shaped to form tabs;
- said flexible sheet is flexible;
- said flexible sheet is translucent; and
- said flexible sheet being made from paper.

16. The binding device of claim 15 wherein said flexible sheet is made from paper.

17. A method of binding documents comprising:
- providing a plurality of documents having an edge;
- providing a flexible sheet having a front surface, a rear surface, a first,
- second, third and fourth edge, a fold that extends parallel to said first edge on said flexible sheet from said second edge to said fourth edge, a plurality of spaced apart apertures in said flexible sheet, adjacent said fold, shaped to form tabs;
- providing a front cover having a front surface, a rear surface, a first, second, third and fourth edge;
- applying an adhesive to an area on said front surface of said flexible sheet adjacent to said first edge;

placing an area of said front surface of said front cover adjacent said first edge of said front cover overlapping said adhesive on said front surface of said flexible sheet;

pressing said front cover firmly down thereby adhering it to said flexible sheet;

providing said plurality of documents within said flexible sheet and said front cover;

aligning said edge of said documents to said tabs of said flexible sheet; and affixing said edge of said documents between said tabs and said flexible sheet.

18. The method of claim 17 further comprising the steps of:

providing a printer; and printing on said front surface of said front cover.

* * * * *